US011044542B2

(12) United States Patent
England et al.

(10) Patent No.: US 11,044,542 B2
(45) Date of Patent: Jun. 22, 2021

(54) COMPOSITE EARCUSHION

(71) Applicant: BOSE CORPORATION, Framingham, MA (US)

(72) Inventors: Raymond O. England, East Greenwich, RI (US); Marek Kawka, Bolton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/678,103

(22) Filed: Nov. 8, 2019

(65) Prior Publication Data

US 2020/0077172 A1 Mar. 5, 2020

Related U.S. Application Data

(63) Continuation-in-part of application No. 16/250,273, filed on Jan. 17, 2019, now Pat. No. 10,659,861, which is a continuation of application No. 15/716,796, filed on Sep. 27, 2017, now Pat. No. 10,187,716.

(51) Int. Cl.

| | |
|---|---|
| ***H04R 25/00*** | (2006.01) |
| ***H04R 1/10*** | (2006.01) |
| ***H04R 5/033*** | (2006.01) |
| ***H04R 1/28*** | (2006.01) |

(52) U.S. Cl.

CPC ..... *H04R 1/1008* (2013.01); *H04R 1/1058* (2013.01); *H04R 1/1083* (2013.01); *H04R 1/288* (2013.01); *H04R 5/033* (2013.01); *G10K 2210/1081* (2013.01)

(58) Field of Classification Search

CPC ..... G10K 11/162; G10K 2210/1081; H04R 1/1008; H04R 1/1058; H04R 1/1083; H04R 1/1091; H04R 1/288; H04R 2420/07; H04R 5/033

USPC ..... 381/370, 371, 372, 376, 378, 379

See application file for complete search history.

(56) References Cited

U.S. PATENT DOCUMENTS

| | | | | |
|---|---|---|---|---|
| 3,691,565 | A * | 9/1972 | Galonek | A61F 9/02 2/431 |
| 4,409,442 | A * | 10/1983 | Kamimura | H04R 5/0335 381/370 |
| 4,989,271 | A * | 2/1991 | Sapiejewski | A61F 11/14 2/209 |
| 5,328,244 | A * | 7/1994 | Ishihara | B60N 2/882 297/391 |

(Continued)

FOREIGN PATENT DOCUMENTS

| | | |
|---|---|---|
| CN | 206402413 U | 8/2017 |
| EP | 2248350 B1 | 7/2015 |
| WO | 201517484 A2 | 2/2015 |

OTHER PUBLICATIONS

International Search Report and Written Opinion from corresponding International Application No. PCT/US2018/052608 dated Nov. 29, 2018.

*Primary Examiner* — Khai N. Nguyen
(74) *Attorney, Agent, or Firm* — Lando & Anastasi, LLP

(57) ABSTRACT

A headphone cushion includes a body formed of a partially reticulated polymeric foam and including a front surface configured to engage or surround an ear or head of a user, side surfaces, and a rear surface. The headphone cushion further includes a layer of high-density polymer material extending over at least a portion of the body.

15 Claims, 16 Drawing Sheets

(56) References Cited

U.S. PATENT DOCUMENTS 5,590,213 A * 12/1996 Urella ..... H04R 5/0335 381/370
5,911,314 A * 6/1999 Urella ..... A61F 11/14 2/209
6,229,901 B1 * 5/2001 Mickelson ..... A61F 11/008 181/128
6,295,366 B1 * 9/2001 Haller ..... H04R 5/0335 379/430
6,420,476 B1 * 7/2002 Yamada ..... H01B 3/442 524/575
6,466,681 B1 * 10/2002 Siska, Jr. ..... H04R 5/0335 381/370
6,597,792 B1 * 7/2003 Sapiejewski ..... H04R 1/1083 381/371
6,856,690 B1 * 2/2005 Skulley ..... H04R 1/1008 381/367
6,940,007 B2 * 9/2005 Schmidt ..... G10D 9/047 84/385 P
7,162,039 B1 * 1/2007 Callahan ..... A61B 7/02 381/374
8,098,872 B2 * 1/2012 Chang ..... H04R 1/1075 381/371
8,170,262 B1 * 5/2012 Liu ..... H04R 1/1016 381/382
8,467,539 B2 6/2013 Sapiejewski et al.
8,577,425 B2 * 11/2013 Kroll ..... H02J 50/20 455/573
8,699,740 B2 * 4/2014 Chiang ..... H04R 1/1008 381/371
8,971,558 B2 * 3/2015 Lunner ..... H04R 25/60 381/323
9,467,761 B2 * 10/2016 Grinker ..... H04R 1/1016
9,808,064 B2 * 11/2017 Taylor ..... H04R 5/0335
9,823,737 B2 * 11/2017 Mazed ..... G10L 15/26
9,902,127 B2 * 2/2018 Peskar ..... B32B 27/26
10,187,716 B1 * 1/2019 England ..... H04R 1/288
10,659,861 B2 * 5/2020 England ..... H04R 1/1008
2008/0069391 A1 * 3/2008 Steyn ..... H04R 1/1083 381/371
2008/0187151 A1 * 8/2008 McClenon ..... H04R 1/12 381/74
2008/0226111 A1 * 9/2008 Wang ..... H04R 1/1058 381/375
2009/0209303 A1 * 8/2009 Kroll ..... H02J 50/00 455/575.2
2009/0262952 A1 * 10/2009 Kuhtz ..... H04R 1/1058 381/74
2010/0119076 A1 * 5/2010 Monk ..... A61F 11/14 381/71.6
2010/0124653 A1 * 5/2010 Tadros ..... B32B 5/18 428/316.6
2011/0007928 A1 * 1/2011 Chang ..... H04R 1/1075 381/378
2011/0031059 A1 * 2/2011 Parish ..... A61F 11/08 181/129
2011/0188696 A1 * 8/2011 Kimura ..... H04R 1/1008 381/378
2013/0022225 A1 * 1/2013 Chiang ..... H04R 1/1075 381/371
2013/0087404 A1 * 4/2013 Peskar ..... B32B 27/40 181/129
2013/0315425 A1 * 11/2013 Lunner ..... H04R 25/60 381/323
2014/0177898 A1 * 6/2014 Granovetter ..... H04R 1/1016 381/380
2014/0211976 A1 * 7/2014 Brunner ..... H04R 1/1091 381/374
2014/0302700 A1 * 10/2014 Makinen ..... H01R 35/00 439/353
2014/0339014 A1 * 11/2014 Varanasi ..... G10K 11/168 181/292
2015/0118932 A1 * 4/2015 Buechler ..... D06N 3/045 442/370
2015/0272292 A1 * 10/2015 Taylor ..... H04R 5/0335 132/275
2015/0307338 A1 * 10/2015 Scott ..... B67B 3/2073 53/331.5
2015/0382094 A1 * 12/2015 Grinker ..... H04R 1/1058 381/380
2016/0086458 A1 * 3/2016 Biggs ..... G08B 6/00 381/151
2017/0006369 A1 * 1/2017 Kenaley ..... H04R 1/023
2017/0136733 A1 * 5/2017 Peskar ..... B32B 25/14
2017/0168303 A1 * 6/2017 Petrov ..... G02B 27/0176
2017/0230746 A1 * 8/2017 Silvestri ..... H04R 1/288
2017/0272853 A1 * 9/2017 Yang ..... H04R 1/1066
2017/0324437 A1 * 11/2017 Ruttler ..... A61B 5/02438
2018/0028099 A1 * 2/2018 Shekarriz ..... A61B 5/14507
2018/0041827 A1 * 2/2018 Abdelmalek ..... H04R 1/1066
2018/0070169 A1 * 3/2018 Annunziato ..... H04R 1/24
2019/0149904 A1 * 5/2019 England ..... H04R 1/288 381/371
2020/0077172 A1 * 3/2020 England ..... H04R 1/1058

* cited by examiner

COMPOSITE EARCUSHION

CROSS-REFERENCE TO RELATED APPLICATIONS

This application claims priority under 35 U.S.C. § 120 as a continuation-in-part of U.S. patent application Ser. No. 16/250,273, titled COMPOSITE EARCUSHION, filed Jan. 17, 2019, now U.S. Pat. No. 10,659,816, which is a continuation of U.S. patent application Ser. No. 15/716,796, titled COMPOSITE EARCUSHION, filed Sep. 27, 2017, now U.S. Pat. No. 10,187,716, both of which are incorporated by reference herein in their entirety for all purposes.

TECHNICAL FIELD

Aspects and implementations of the present disclosure are directed generally to a composite earcushion and to headphones including same.

BACKGROUND

Wireless and mobile electronic devices are increasingly popular. In some instances, the sound generated by the wireless and mobile electronic devices is transmitted through wires to one or more speakers that are positioned adjacent to the user's ears. In some instances, the generated sound can be transmitted to speakers via wireless transmission devices. One example of a speaker system positioned adjacent to the user's ears is a set of headphones.

In addition to speakers, headphones can include materials for softening the contact of the headphones against the user's ear (a supra-aural design) or against portions of the user's head adjacent to the user's ears (a circum-aural design). The materials are intended to provide comfort to the user as the headphones are used and may reduce the amount of external noise reaching the user's ear and/or may absorb noise such as audio rendered by an audio driver of the headphones that is reflected from a portion of the user's ear or head, or any reverberant sound wave within the earcushion plenum. These materials may be formed into what is referred to herein as headphone cushions or earcushions.

SUMMARY

In accordance with an aspect of the present disclosure, there is provided a headphone cushion that includes a body formed of a partially reticulated polymeric foam, the body including a front surface configured to engage or surround an ear or head of a user, side surfaces, and a rear surface. The headphone cushion further includes a layer of high-density polymer material extending over at least a portion of the body.

The headphone cushion may further include a snap ring at least partially embedded in the body, the snap ring including a periphery configured to engage one or more retention elements of an earcup of a headphone. The snap ring may include a curved portion having a concave surface facing away from the ear of the user when the front surface of the headphone cushion is held adjacent the ear or head of the user. The curved portion of the snap ring may form an acoustic wall that improves passive transmission loss performance of the headphone cushion for acoustic frequencies in a range of about 0.2 kHz to about 6.5 kHz. The body may include a stepped portion extending from the rear surface of the body and onto one of an internal periphery and an external periphery of a rear surface of the snap ring.

The headphone cushion may further include a non-porous film on the front and side surfaces of the body, the non-porous film being distinct from the layer of high-density polymer material.

The high-density polymer material may include at least one of silicone and molybdenum.

The layer of high-density polymer material may extend over at least a portion of the front surface. The layer of high-density polymer material may extend at least substantially entirely over the front surface and uniformly coat the front surface.

The rear portion of the body may include at least one cavity defined between an inner periphery and an outer periphery of the rear portion of the body.

The layer of high-density polymer material may have a thickness of between about 10 μm and about 100 μm.

In accordance with another aspect of the present disclosure, there is provided a headset including an earcup having a front opening configured to be adjacent to an ear or head of a user when worn by the user. The headset further includes a headphone cushion secured to the front opening of the earcup. The headphone cushion includes a body formed of a partially reticulated polymeric foam, the body including a front surface configured to engage or surround the ear or head of the user, and a rear surface. The headphone cushion further includes a layer of high-density polymer material extending over at least a portion of the body.

The headphone cushion may further include a snap ring at least partially embedded in and integrally formed with the body, the snap ring including a periphery configured to engage one or more retention elements of the earcup. The snap ring may include a curved portion that has a concave surface that faces away from the ear of the user when the front surface of the headphone cushion is held adjacent the ear or head of the user. The one or more retention elements of the earcup may include one or more detents extending inwardly from an inner wall of the earcup. The snap ring may be configured to engage rear surfaces of the one or more detents to secure the headphone cushion to the front opening of the earcup. The one or more retention elements of the earcup may include one or more slots configured to receive one or more respective tabs extending from a rear surface of the snap ring.

The headphone cushion may further include a non-porous film integral with the front surface of the body, the non-porous film being distinct from the layer of high-density polymer material.

The body of the headphone cushion may include a stepped portion extending from the rear surface of the body, onto an internal periphery of a rear surface of the snap ring, and into an interior portion of the earcup.

In accordance with another aspect of the present disclosure, there is provided a method of forming a headphone cushion. The method includes molding a body, the body being formed of a partially reticulated polymeric foam and including a front surface configured to engage or surround an ear or head of a user, side surfaces, and a rear surface. The method further includes applying a layer of high-density polymer material to at least a portion of the body.

The body may be molded around a snap ring, the snap ring being at least partially embedded in and integrally formed with the body and including a periphery configured to engage one or more retention elements of an earcup of a headphone. The snap ring may include a curved portion that has a concave surface that faces away from the ear of the user when the front surface of the headphone cushion is held adjacent the ear of the user.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
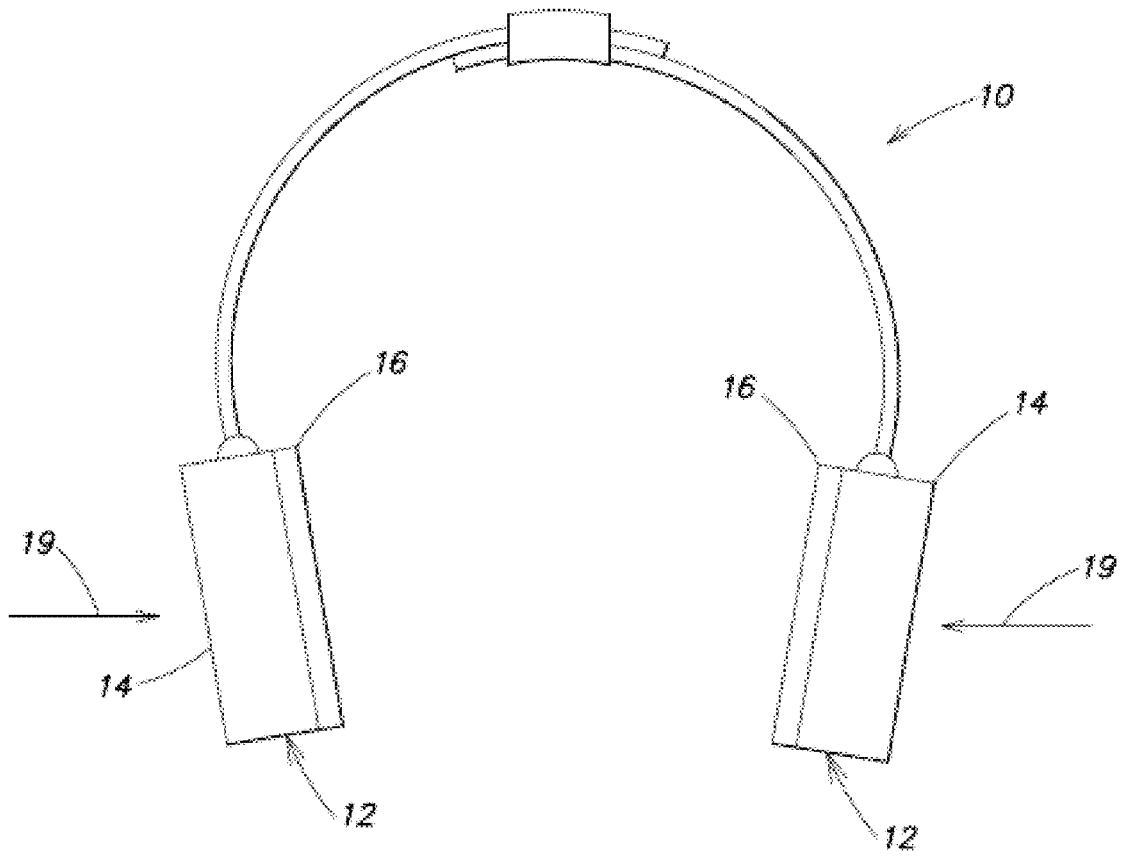
FIG. 1 is an elevational view of an example of a headphone.

Aspects and implementations disclosed herein are not limited to the details of construction and the arrangement of components set forth in the following description or illustrated in the drawings. Aspects and implementations disclosed herein are capable of being practiced or of being carried out in various ways.

Figure 2A:
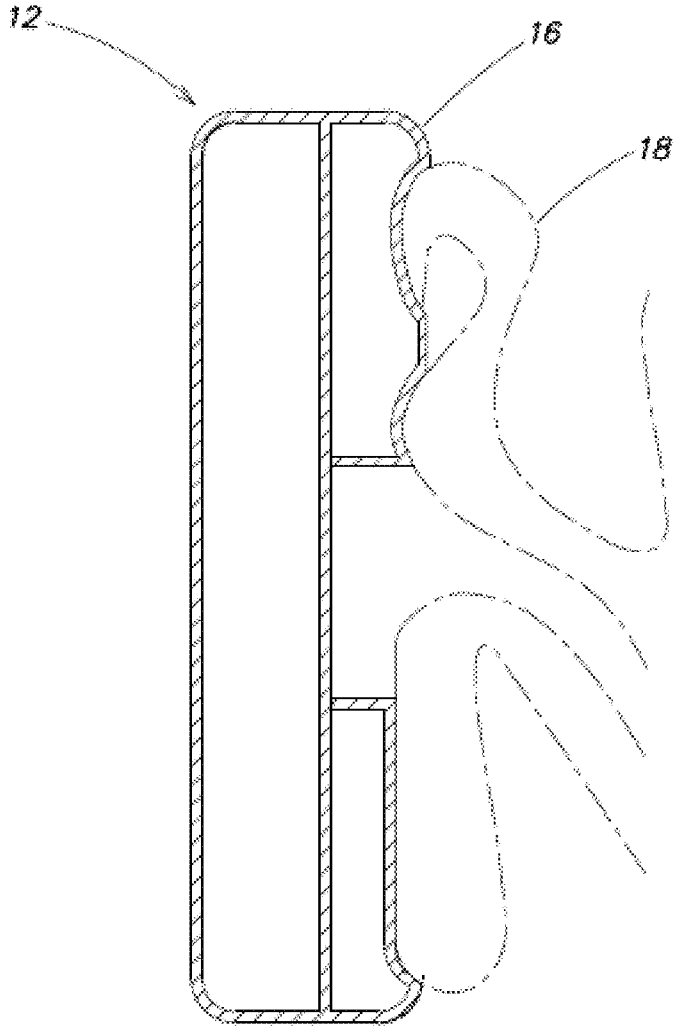
FIG. 2A illustrates an example of a supra-aural headphone cushion disposed against an ear of a user.
Figure 2B:
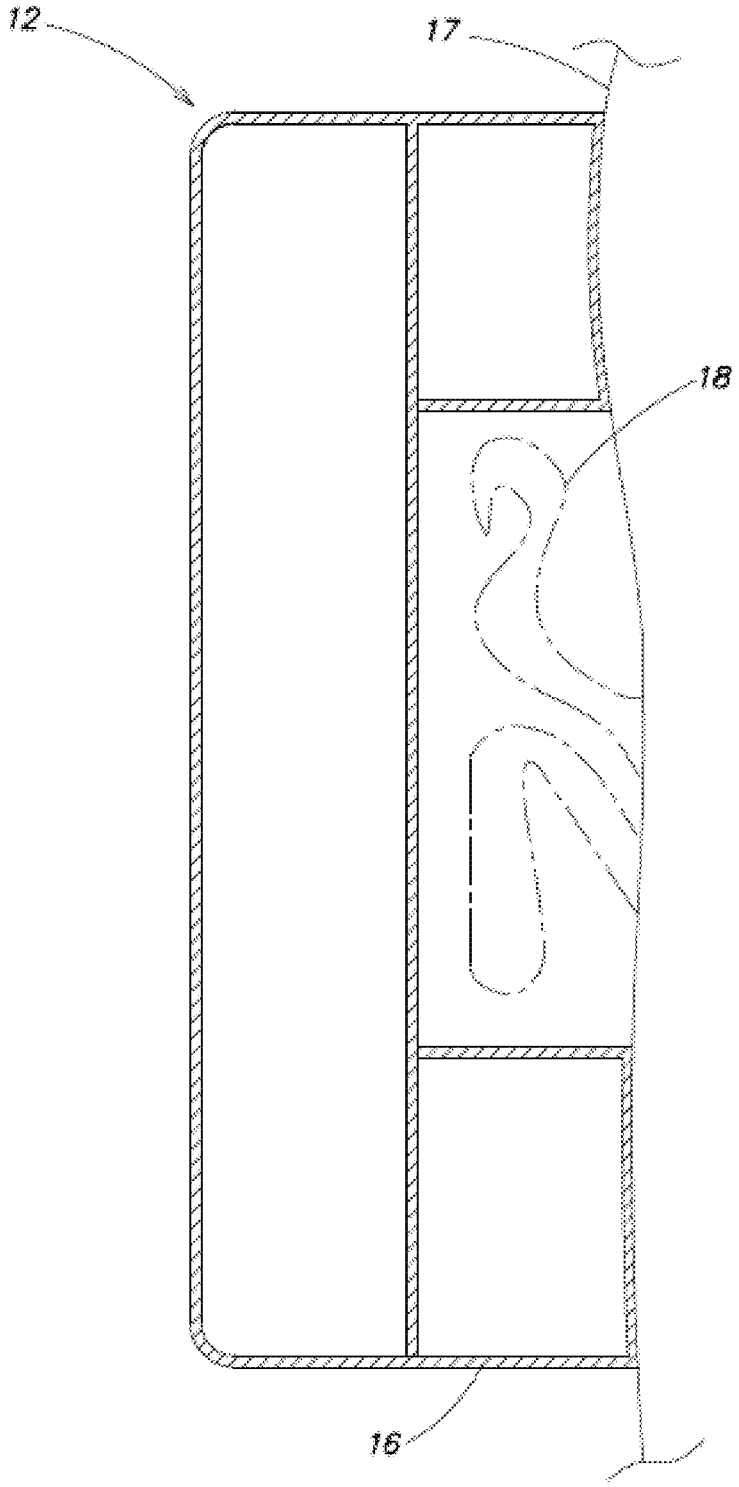
FIG. 2B illustrates an example of a circum-aural headphone cushion disposed against a head of a user.

Referring to FIG. 1, there is shown an example of a headphone 10. The headphone 10 includes two earphones 12, connected by a headband. Each earphone 12 includes a cup shaped shell or earcup 14 and an earcushion 16. The headband exerts a force in an inward direction as represented by arrows 19. In some implementations, headphone 10 is a supra-aural headphone. When worn by a user, the earcushions 16 rest against the user's ears 18 and may deform slightly to form a seal against the user's ears 18, as illustrated in FIG. 2A. In other implementations, headphone 10 is a circum-aural headphone and when worn by a user, the earcushions 16 rest against portions of the user's head 17 surrounding the user's ears 18 and may deform slightly to form a seal against the portions of the user's head, as illustrated in FIG. 2B. The seal of the earcushion 16 against the ears of the user or against the portion of the head of the user about the ears of the user may reduce the total external acoustic energy reaching the ear canals of the user.

Figure 3A:
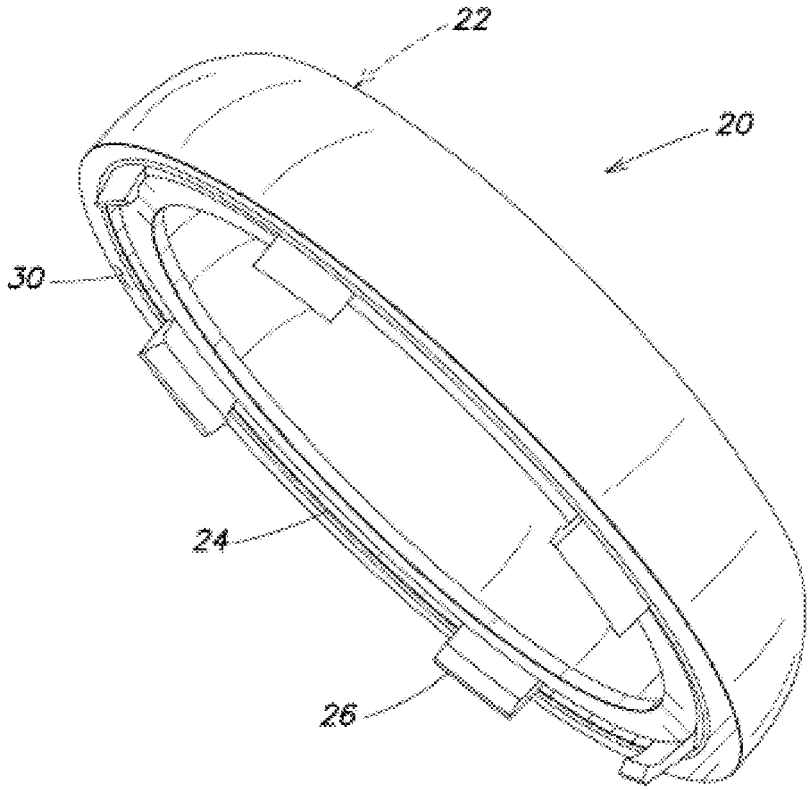
FIG. 3A is an isometric view of an implementation of a headphone cushion.
Figure 3B:
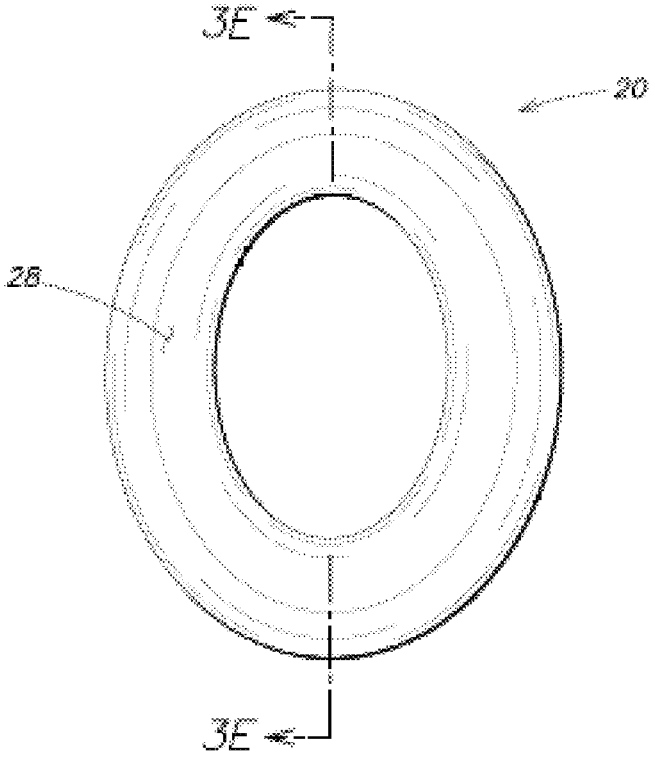
FIG. 3B is a plan view from the top of the headphone cushion of FIG. 3A.
Figure 3C:
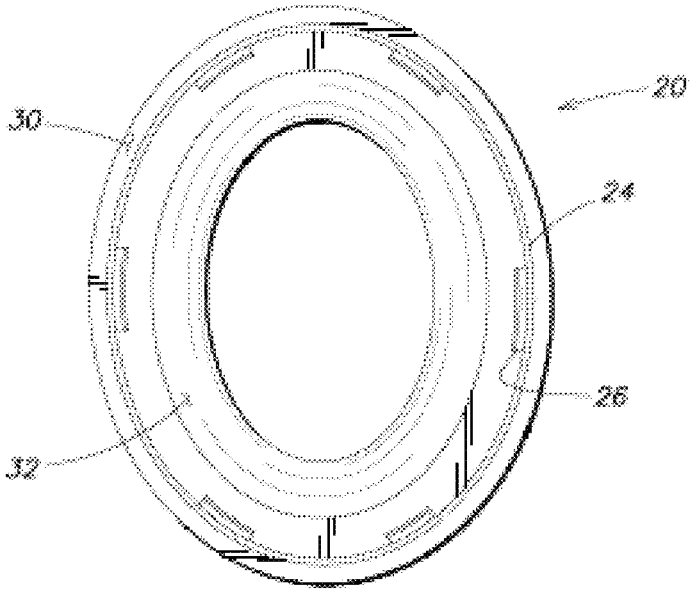
FIG. 3C is a plan view from the bottom of the headphone cushion of FIG. 3A.
Figure 3D:
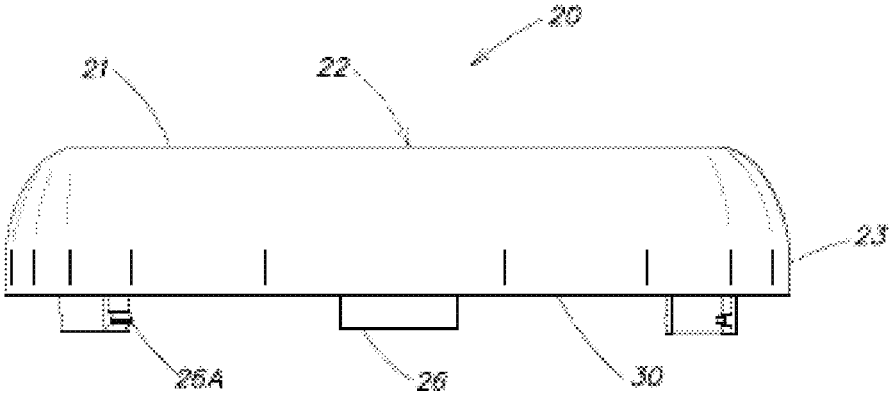
FIG. 3D is an elevational view of the headphone cushion of FIG. 3A.
Figure 3E:
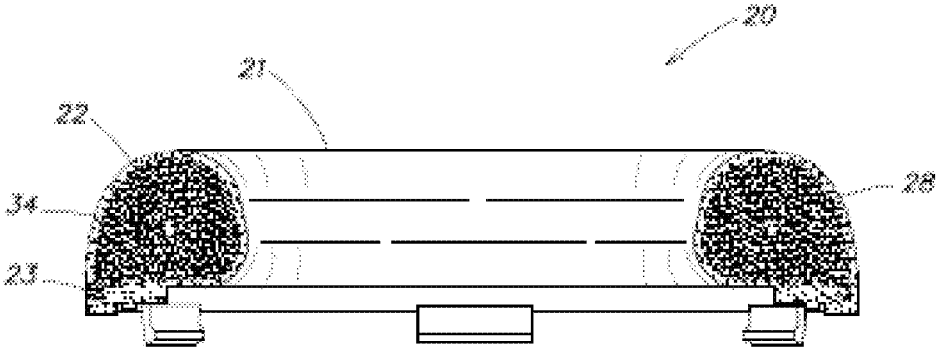
FIG. 3E is a cross-sectional view of the headphone cushion of FIG. 3A along line 3E of FIG. 3B.

One implementation of an earcushion 20 is illustrated in isometric view in FIG. 3A, in a plan view from the top (the user contacting side) in FIG. 3B, in a plan view from the bottom (the headphone earcup contacting side) in FIG. 3C, in an elevational view in FIG. 3D, and in a cross-sectional view in FIG. 3E. The earcushion 20 may be substantially oval in shape and may be sized to either rest against or surround a user's ear 18.

Figure 4A:
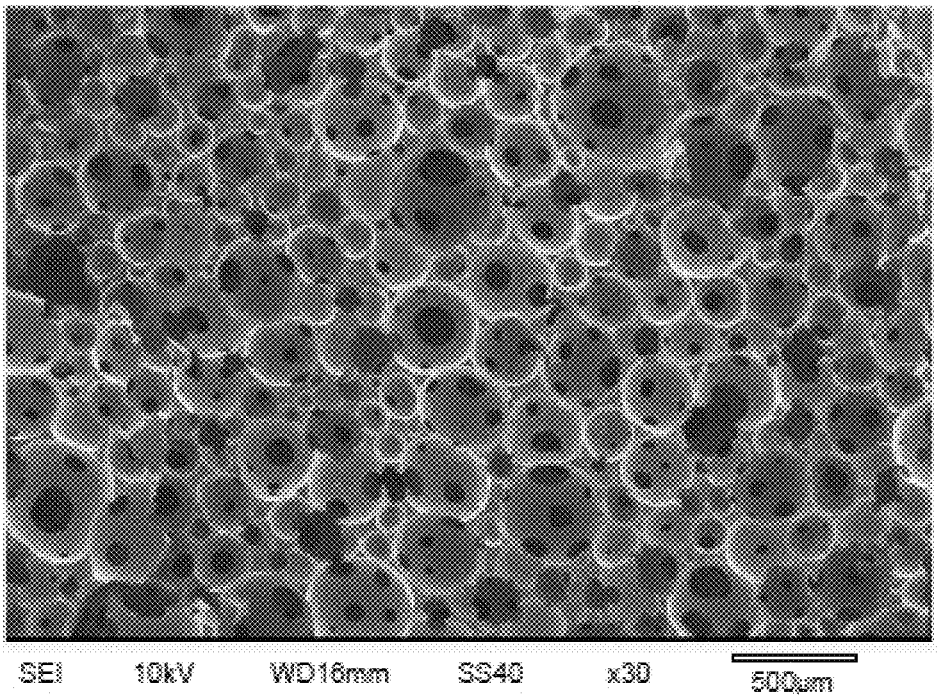
FIG. 4A illustrates cells of foam in the bulk of the body of examples of a headphone cushion.
Figure 4B:
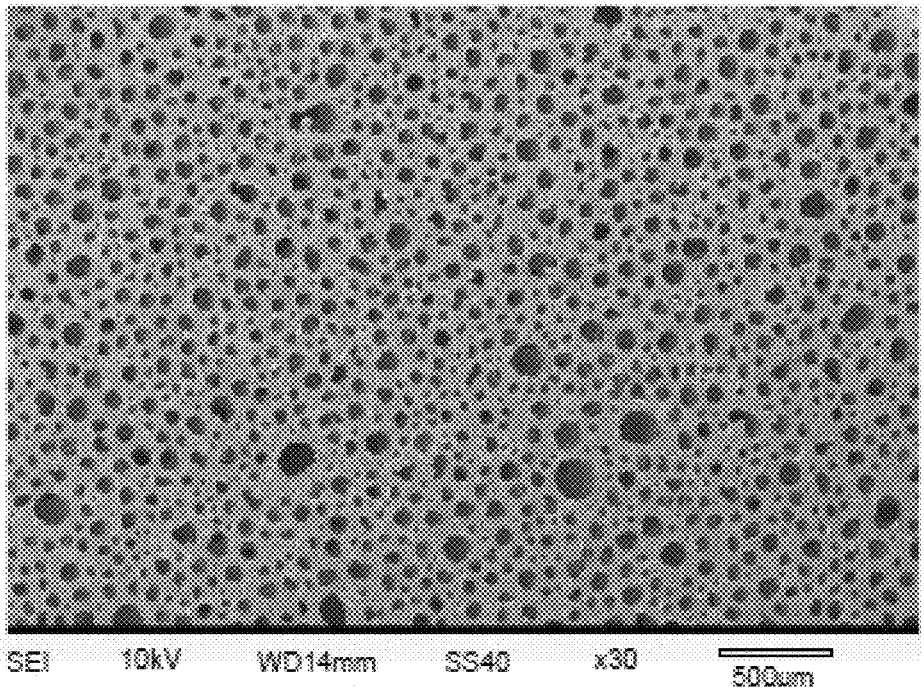
FIG. 4B illustrates cells of foam in a surface of the body of examples of a headphone cushion.

The earcushion 20 includes a foam body 22 having an upper surface 21, side surfaces 23, and a lower surface 32. The foam body 22 may include or consist of a bulk, or inner portion, and an outer surface. Both may include or consist of a polyurethane foam and/or another type of compliant material. The material of the bulk of the foam body 22 may be a partially reticulated polymer foam having cell sizes within the bulk of the foam body 22 with diameters of between about 100 μm and about 750 μm, for example, as illustrated in FIG. 4A. The cell size at the outer surface of the foam body 22 may be smaller than that in the bulk of the foam body 22, for example, with diameters of between about 25 μm and about 100 μm, as illustrated in FIG. 4B. When uncovered by another material, the outer surface of the foam body 22 may be at least partially acoustically transparent to allow sound waves to pass through the outer surface and into the bulk of the foam body 22. The foam body 22 may allow air to flow through at a rate of about 10 $cm^3/cm^3 \cdot$second or less and may have an acoustic dampening peak at between about 1 kHz and about 2.5 kHz.

In some implementations, the upper surface 21 and side surfaces 23 of the foam body 22 may be covered by a substantially or wholly non-porous material 28 that reduces the amount of external noise entering into the foam body 22 through the upper surface 21 and side surfaces 23 of the foam body 22 and travelling to the ear of a user wearing a headphone 10 fitted with the earcushion 20. In some examples, the material 28 may be a high-density polymer material, such as silicone rubber having a density in the range of 0.7 $g/cm^3$ to 3.8 $g/cm^3$. The high-density polymer material may include metallic particles, wherein the metallic particles increase the density of the high-density polymer material 28. In some examples, the metallic particles may be molybdenum. Alternatively, the particles may be formed of another material, which may not be metallic. The particles may be significantly smaller than the smallest cell of the bulk of the foam body 22. For example, the particles may have characteristic dimensions, for example, diameters, in the range of less than 1 μm to about 10 μm.

In other implementations, the material 28 may be an acrylic paint film. The acrylic paint film may have a thickness in the range of about 1-5 μm, for example. In some examples, the acrylic paint film has a thickness of about 1 μm. The acrylic paint film may be more durable than materials such as polyurethane leather (pleather) used in some previous examples of earcushions and may thus have an extended life and may not shed particulate matter as some pleather materials do. The color of the acrylic paint film may be selected as desired by a manufacturer. The upper surface 21 and side surfaces 23 of the foam body 22 may be substantially smooth and include no pleats, folds, or creases. In other implementations, the upper surface 21 and/or side surfaces 23 of the foam body 22 may be molded to include a surface pattern resembling, for example, natural leather.

Moreover, in some implementations, the upper surface 21 and side surfaces 23 of the foam body 22 may be covered in two or more layers. For example, the upper surface 21 and side surfaces 23 of the foam body 22 may be covered in two layers, wherein one of the layers may be an acrylic paint film and the other layer a high-density polymer material. The acrylic paint film layer and high-density polymer material layer may be formed as described above.

Figure 5:
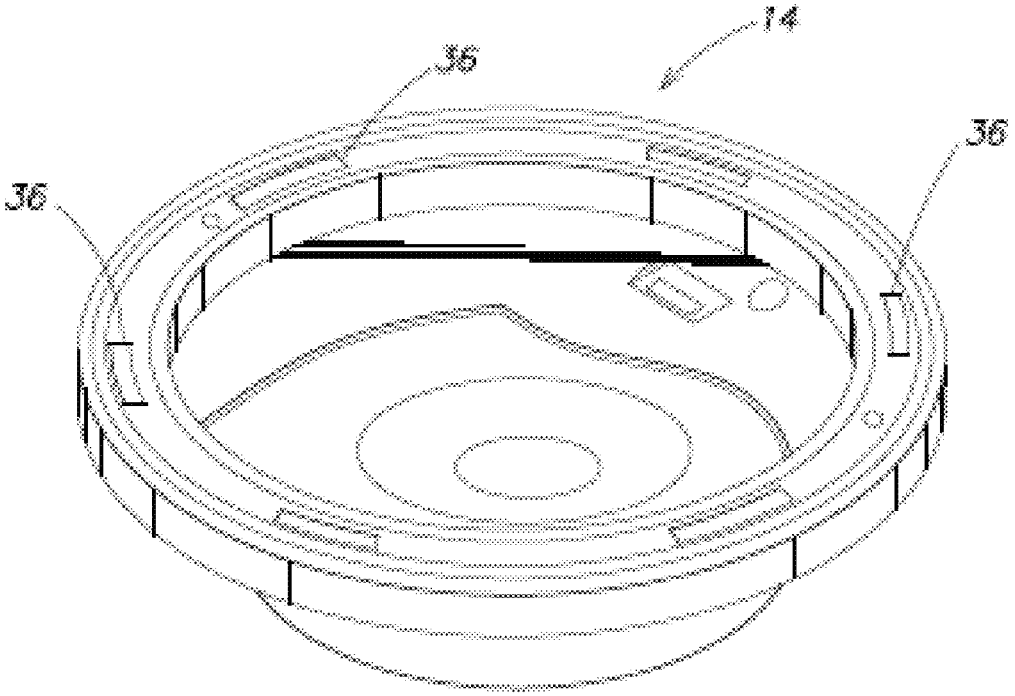
FIG. 5 illustrates an example of an earphone earcup configured to retain the headphone cushion of FIG. 3A.

As shown in FIG. 3A, the earcushion 20 includes a snap ring 24 at least partially embedded in the foam body 22 proximate the lower surface 32 of the foam body 22. In an example, the snap ring 24 includes one or more prongs 26 extending downward from the lower surface of the snap ring 24. Six prongs 26 are illustrated in the snap ring 24 of earcushion 20 although other examples may include fewer or greater numbers of prongs 26. The lower ends of the prongs 26 opposite from the ends of the prongs 26 connected to the snap ring 24 may include hook-like structures 26A (see FIG. 3D). The prongs 26 and their hook-like structures 26A are used to retain the prongs 26, and by extension, the entire earcushion 20 in an earcup 14 of a headphone 10 having complimentary recesses 36, as illustrated in the example shown in FIG. 5. In some examples, the snap ring may be insert molded with the foam body 22 of the earcushion 20.

The snap ring 24 and prongs 26 may be formed of a material with a greater rigidity than that of the material of the body 22 of the earcushion 20. The snap ring 24 and prongs 26 may include or comprise a substantially rigid polymer, for example, polycarbonate (PC), acrylonitrile-butadiene-styrene (ABS), acrylic, or poly(methyl methacrylate).

Referring to FIGS. 10A-10D, in some implementations, the snap ring 24 includes a protrusion or acoustic wall 27. The protrusion or acoustic wall 27 may be made of one or more of PC, ABS, and/or another material. The snap ring 24 may be a single construction, as molded, that includes the protrusion or acoustic wall 27. The protrusion or acoustic wall 27 may act as a barrier that reflects some amount of acoustic noise from outside the earcushion 20 that passes through the earcushion 20 to the ear of the user as compared to a similar earcushion 20 without the protrusion or acoustic wall 27. In some implementations, the protrusion or acoustic wall 27 may also absorb some amount of acoustic noise from outside the earcushion 20. As a result, the presence of the protrusion or acoustic wall 27 may increase the acoustic energies reflected and/or absorbed by the earcushion 20, thereby improving the passive transmission loss performance across the earcushion 20. In some implementations, acoustic energies with an acoustic frequency in a range of about 0.1 kHz to 10 kHz may be reflected and/or absorbed, resulting in a lower amount of acoustic energies reaching the user's ears 18.

Figure 10A:
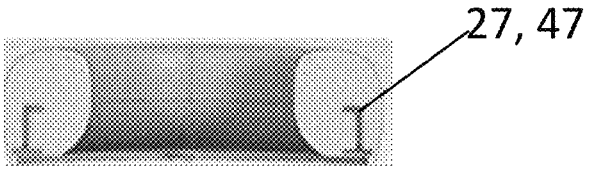
FIG. 10A illustrates an example of a headphone cushion with an L-shaped acoustic wall.
Figure 10B:
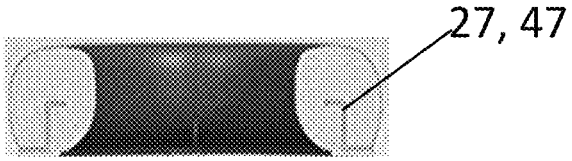
FIG. 10B illustrates another example of a headphone cushion with an L-shaped acoustic wall.
Figure 10C:
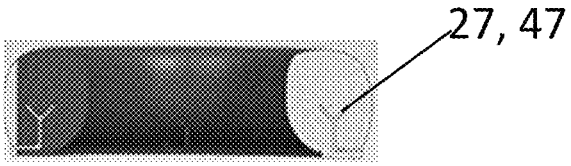
FIG. 10C illustrates an example of a headphone cushion with a Y-shaped acoustic wall.
Figure 10D:
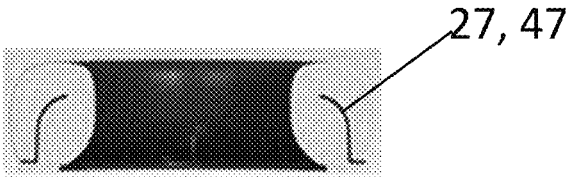
FIG. 10D illustrates an example of a headphone cushion with a curved acoustic wall.

As shown in FIG. 10D, in some examples, the cross-section of the protrusion or acoustic wall 27 may be curved. In other examples, such as the examples shown in FIGS. 10A-10C, the cross-section of the protrusion or acoustic wall 27 may be straight, or have an L-shape, T-shape, or Y-shape, though other shapes may be used.

Figure 8:
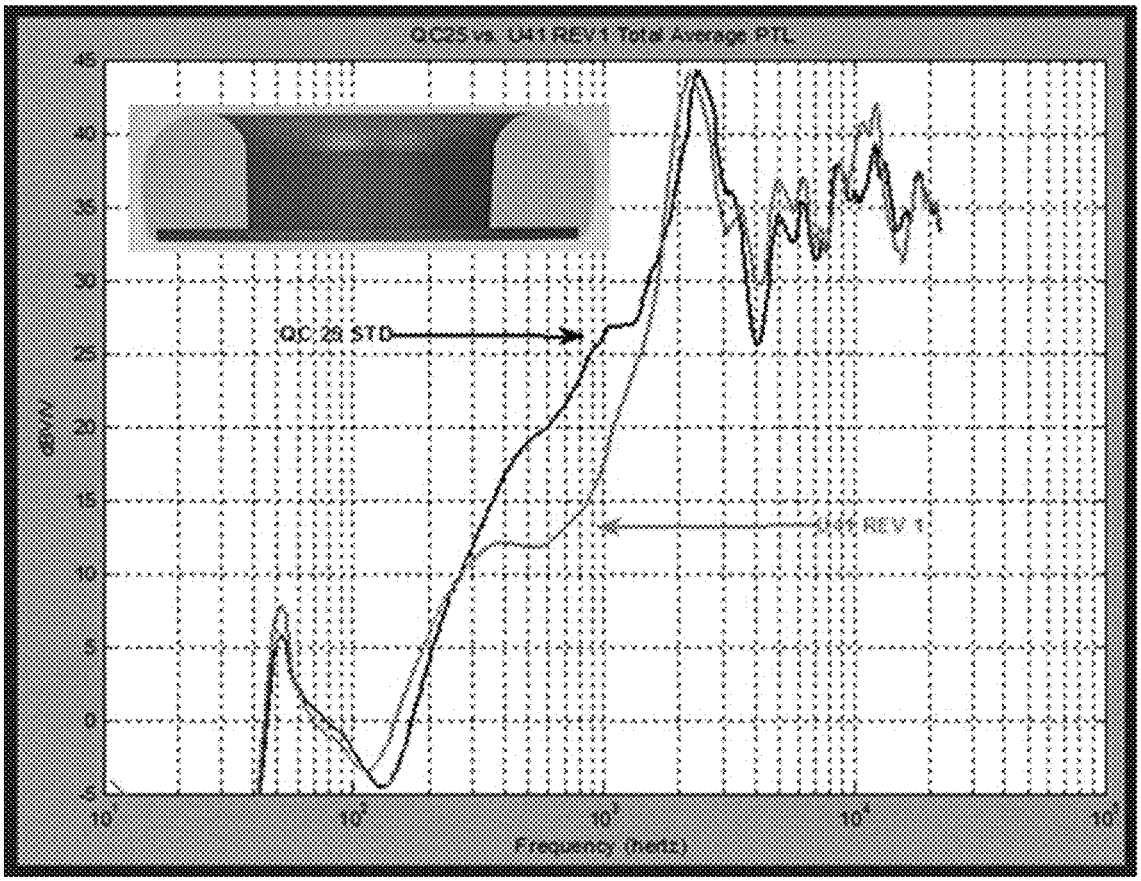
FIG. 8 is a graph depicting passive transmission loss as a function of frequency for an example of a headphone cushion.
Figure 9:
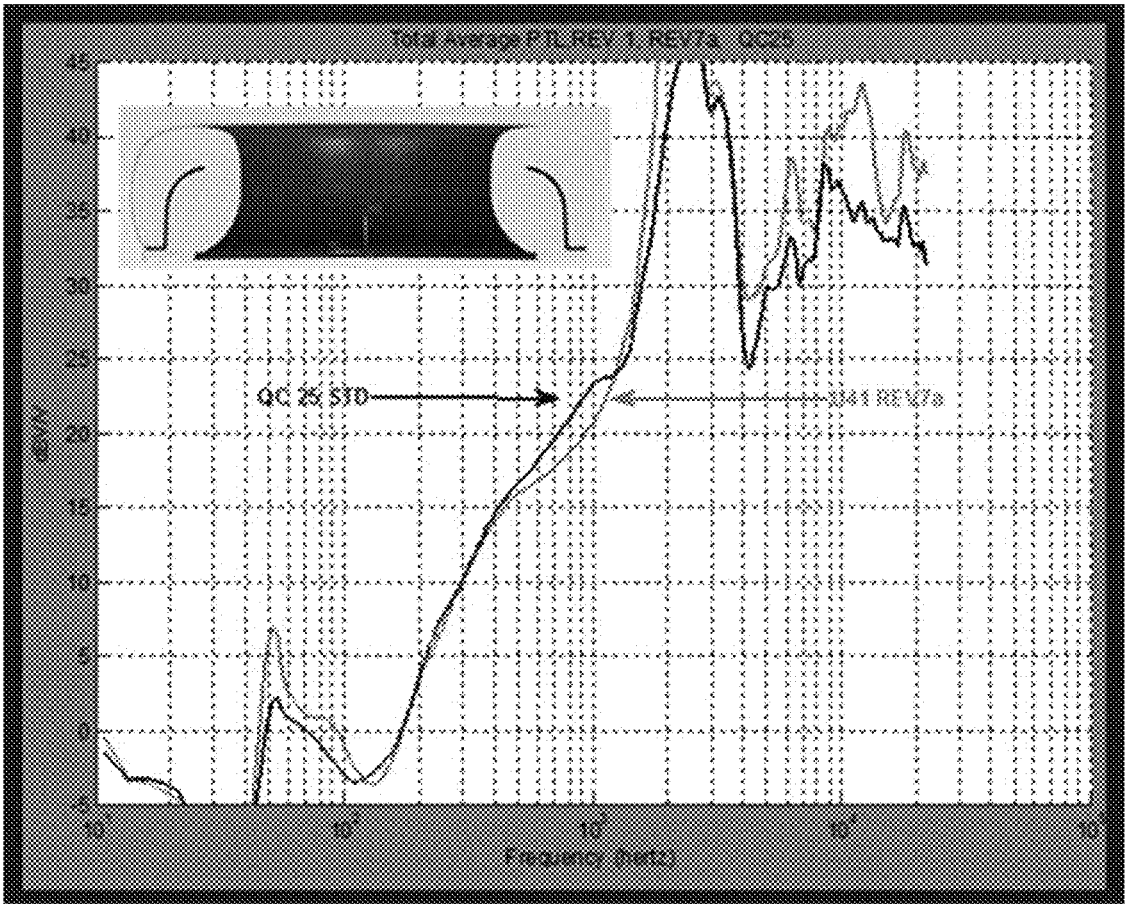
FIG. 9 is a graph depicting passive transmission loss as a function of frequency for another example of a headphone cushion.

The presence of the protrusion or acoustic wall 27 reflects the acoustic energies incident upon it and prevents them from reaching the ear canal, thereby improving the passive transmission loss performance across the earcushion 20. FIG. 8 depicts test results for acoustic energy absorption in an example of an earcushion 20 without an acoustic wall 27, showing passive transmission loss across a range of frequencies. FIG. 9 depicts test results for acoustic energy absorption in an example of an earcushion 20 having a curved acoustic wall 27 (such as that shown in FIG. 10D). FIG. 9 indicates that, at frequencies above 1 kHz, the resulting passive transmission loss is significantly higher, indicating that more acoustic energies have been absorbed in the example of an earcushion 20 having a curved acoustic wall.

Returning to discussion of FIGS. 3A-3E, in some implementations, a stepped portion 30 may extend from the rear surface 32 of the body 22 of the earcushion 20 and onto an external periphery of a rear surface of the snap ring 24. The stepped portion 30 may facilitate retention of the snap ring 24 in the body 22 of the earcushion 20, thereby providing an improved seal.

At least a portion of the rear surface 32 of the body 22 of the earcushion 20 inside an inner periphery of the snap ring 24 (see FIG. 3C) may be free of the substantially or wholly non-porous material 28, thus exposing the pores on the rear surface 32 of the body 22 of the earcushion 20. The rear surface 32 of the body 22 of the earcushion 20 may thus be at least partially acoustically transparent and may allow acoustic energy to pass through the rear surface 32 of the body 22 of the earcushion 20 and into the bulk of the body 22 of the earcushion 20. The earcushion 20 may thus absorb undesirable acoustic energy present in a volume defined between the earcup 14 of a headphone 10 and the head or ear of a user, for example, sound rendered by an acoustic driver of the headphone and reflected from the ear or head of the user, or any other reverberant acoustic energy present within the earcup plenum. Absorption of such acoustic energy may increase the quality of audio perceived by a user wearing a headphone 10 fitted with the earcushion 20.

As illustrated in FIG. 3E, an acoustic damper 34 may be embedded within the body 22 of the earcushion 20 (in this example, at or near the cross-sectional center of the body 22 of the earcushion 20). The acoustic damper 34 may include or consist of a material having a density greater than a density of the partially reticulated polymeric foam forming the body 22 of the earcushion 20. The material of the acoustic damper 34 may include, for example, silicone or another polymeric material having a density greater than a density of the partially reticulated polymeric foam forming the body 22 of the earcushion 20. The acoustic damper 34 may be a ring or a rope having a substantially oval or circular shape. Alternatively, the acoustic damper 34 may be embedded as a high-density powder (e.g., a metal powder) dispersed throughout the body 22 of the earcushion 20 at regular or random intervals. The acoustic damper 34 may increase the effective density of the body 22 of the earcushion 20 to reduce the amount of acoustic noise from outside the earcushion 20 that passes through the earcushion 20 to the ear of the user as compared to a similar earcushion 20 without the acoustic damper 34.

Figure 6A:
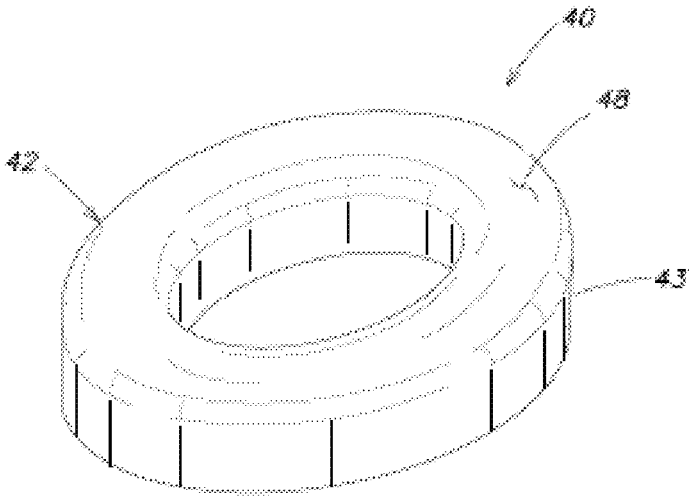
FIG. 6A is an isometric view of another implementation of a headphone cushion.
Figure 6B:
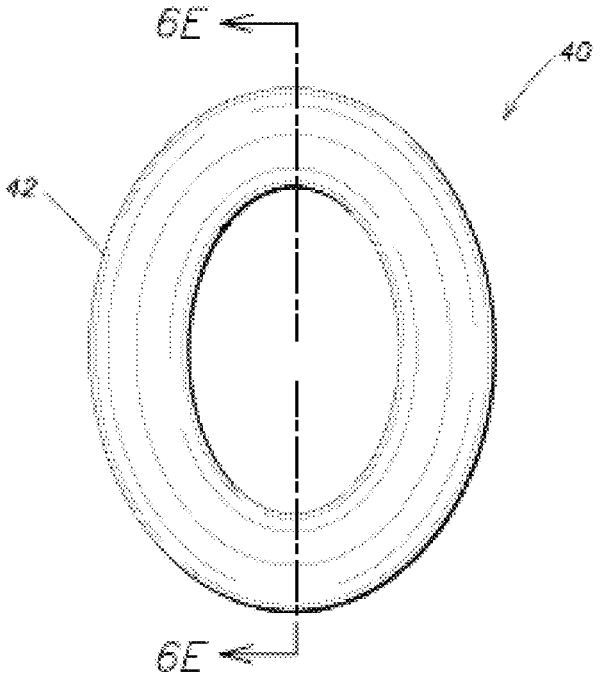
FIG. 6B is a plan view from the top of the headphone cushion of FIG. 6A.
Figure 6C:
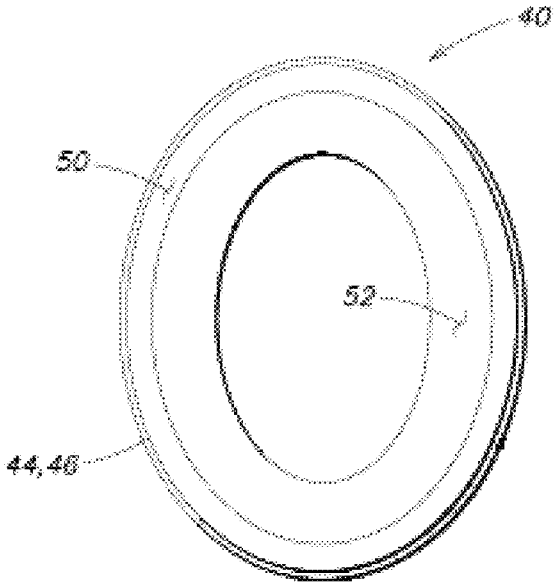
FIG. 6C is a plan view from the bottom of the headphone cushion of FIG. 6A.
Figure 6D:
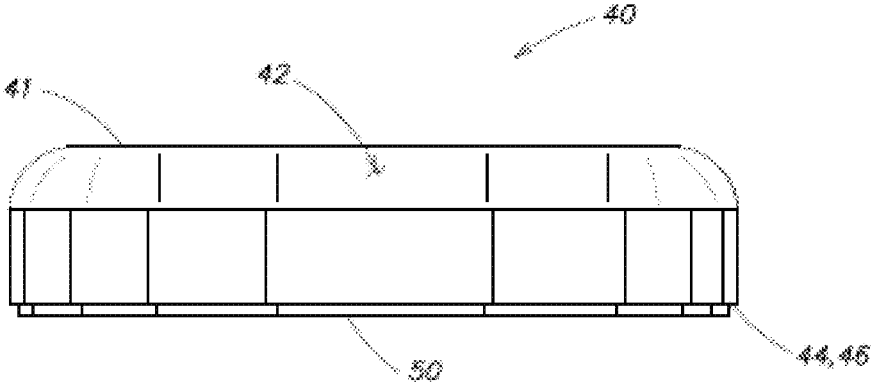
FIG. 6D is an elevational view of the headphone cushion of FIG. 6A.
Figure 6E:
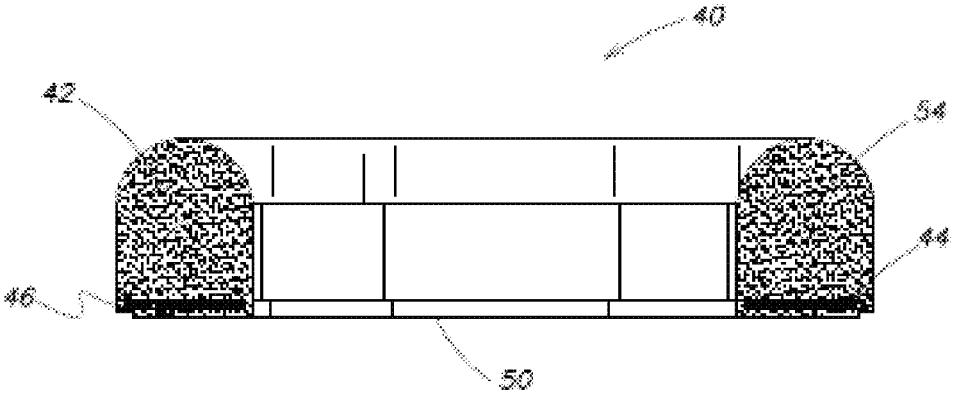
FIG. 6E is a cross-sectional view of the headphone cushion of FIG. 6A along line 6E of FIG. 6B.

Another implementation of an earcushion 40 is illustrated in isometric view in FIG. 6A, in a plan view from the top (the user contacting side) in FIG. 6B, in a plan view from the bottom (the headphone earcup contacting side) in FIG. 6C, in an elevational view in FIG. 6D, and in a cross-sectional view in FIG. 6E. The earcushion 40 may be substantially oval in shape and may be sized to either rest against or surround a user's ear 18.

The earcushion 40 includes a foam body 42 having an upper surface 41, side surfaces 43, and a lower surface 52. The foam body 42 may include or consist of a bulk, or inner portion, and an outer surface. Each of the bulk and the outer surface may include or consist of a polyurethane foam and/or another type of compliant material. The material of the bulk of the foam body 42 may be a partially reticulated polymer foam having cell sizes within the bulk of the foam body 42 with diameters of between about 100 μm and about 750 μm, for example, as illustrated in FIG. 4A. The cell size at the outer surface of the foam body 42 may be smaller than that in the bulk of the foam body 42, for example, with diameters of between about 25 μm and about 100 μm, as illustrated in FIG. 4B. When uncovered by another material, the outer surface of the foam body 42 may be at least partially acoustically transparent to allow sound waves to pass through the outer surface and into the bulk of the foam body 42. The foam body 42 may allow air to flow through at a rate of about 10 $cm^3/cm^3 \cdot$second or less and may have an acoustic dampening peak at between about 1 kHz and about 2.5 kHz.

In some implementations, the upper surface 41 and side surfaces 43 of the foam body 42 may be covered by a substantially or wholly non-porous material 48 which impedes acoustic pressure waves incident on the foam body 42 through the upper surface 41 and side surfaces of the foam body 42 and prevents to a certain degree these pressure waves travelling to the ear of a user wearing a headphone 10 fitted with the earcushion 40. In some examples, the material 48 may be a high-density polymer material, such as silicone rubber having a density in the range of 0.7 $g/cm^3$ to 3.8 $g/cm^3$. The high-density polymer material may include metallic particles, wherein the metallic particles increase the density of the high-density polymer material 48. In some examples, the metallic particles may be molybdenum. Alternatively, the particles may be formed of another material, which may not be metallic. The particles may be significantly smaller than the smallest cell of the bulk of the foam body 42. For example, the particles may have characteristic dimensions, for example, diameters, in the range of less than 1 μm to about 10 μm.

In some implementations, the substantially or wholly non-porous material 48 may be an acrylic paint film. The acrylic paint film may have a thickness in the range of about 1-5 μm, for example. In some examples, the acrylic paint film has a thickness of about 1 μm. The color of the acrylic paint film may be selected as desired by a manufacturer. The acrylic paint film may be more durable than materials such as pleather used in some previous examples of earcushions and may thus have an extended life and may not shed particulate matter as some pleather materials do. The upper surface 41 and side surfaces 43 of the foam body 42 may be substantially smooth and include no pleats, folds, or creases. In other implementations, the upper surface 41 and/or side surfaces 43 of the foam body 42 may be molded to include a surface pattern resembling, for example, natural leather.

Moreover, in some implementations, the upper surface 41 and side surfaces 43 of the foam body 42 may be covered in two or more layers. For example, the upper surface 41 and side surfaces 43 of the foam body 42 may be covered in two layers, wherein one of the layers may be an acrylic paint film and the other layer a high-density polymer material. The acrylic paint film layer and high-density polymer material layer may be formed as described above.

Figure 7:
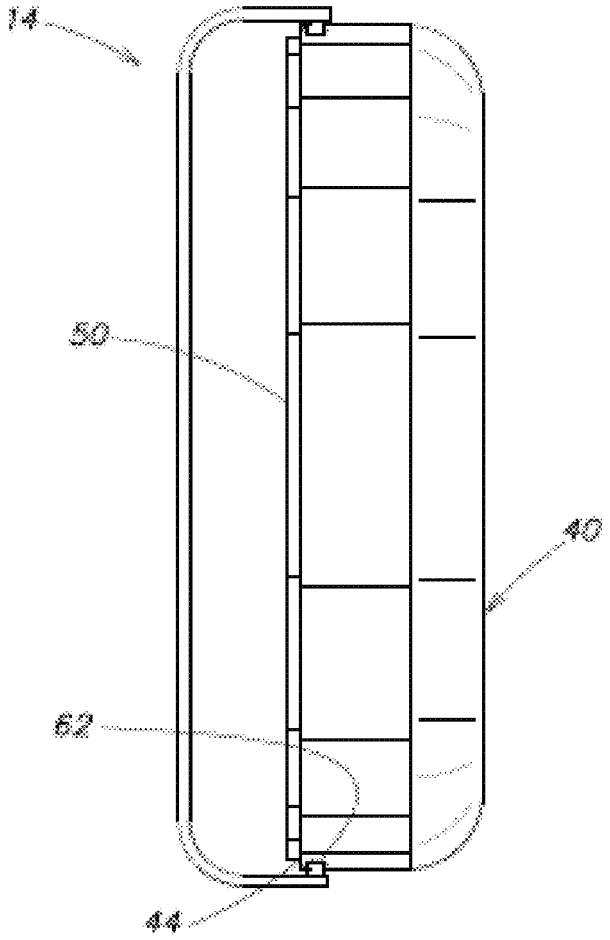
FIG. 7 illustrates an example of an earphone earcup retaining the headphone cushion of FIG. 6A.

The earcushion 40 includes a snap ring 44 at least partially embedded in the foam body 42 proximate the lower surface 52 of the foam body 42. In an example, an outermost periphery of a front surface of the snap ring 44 may be substantially coextensive with an outer periphery of the foam body 42 of the earcushion 40. Front and rear surfaces of the snap ring 44 may be substantially planar. In other examples, the snap ring 44 may have a T-shaped cross-section for enhanced mechanical strength. The outer periphery of the snap ring 44 is configured to engage with tabs or detents 62 in an inner surface of an earcup 14 of a headphone 10 (see FIG. 7) to retain the earcushion 40 in the earcup 14.

The snap ring 44 may be formed of a material with a greater rigidity than that of the material of the body 42 of the earcushion 40. The snap ring 44 may include or comprise a substantially rigid polymer, for example, polycarbonate (PC), acrylonitrile-butadiene-styrene (ABS), acrylic, or poly (methyl methacrylate).

Referring to FIGS. 10A-10D, in some implementations, the snap ring 44 includes a protrusion or acoustic wall 47. The protrusion or acoustic wall 47 may be made of one or more of PC, ABS, and/or another material. The snap ring 44 may be a single construction, as molded, that includes the protrusion or acoustic wall 47. The protrusion or acoustic wall 47 may act as a barrier that reflects some amount of acoustic noise from outside the earcushion 40 that passes through the earcushion 40 to the ear of the user as compared to a similar earcushion 40 without the protrusion or acoustic wall 47. In some implementations, the protrusion or acoustic wall 47 may also absorb some amount of acoustic noise from outside the earcushion 40. As a result, the presence of the protrusion or acoustic wall 47 may increase the acoustic energies reflected and/or absorbed by the earcushion 40, thereby improving the passive transmission loss performance across the earcushion 40. In some implementations, acoustic energies with an acoustic frequency in a range of about 0.1 kHz to 10 kHz may be reflected and/or absorbed, resulting in a lower amount of acoustic energies reaching the user's ears 18.

As shown in FIG. 10D, in some examples, the cross-section of the protrusion or acoustic wall 47 may be curved. In other examples, such as the examples shown in FIGS. 10A-10C, the cross-section of the protrusion or acoustic wall 47 may be straight, or have an L-shape, T-shape, or Y-shape, though other shapes may be used.

Returning to discussion of FIGS. 6A-6H, a stepped portion 50 may extend from the rear surface 52 of the body 42 of the earcushion 40 and onto an internal periphery of a rear surface of the snap ring 44. The stepped portion 50 may facilitate connection of the snap ring 44 and the body 42 of the earcushion 40, thereby providing an improved seal. An outer peripheral portion 46 of the rear surface of the snap ring 44 may extend outwardly from beneath the stepped portion 50 of the body 42 of the earcushion 40. The outer peripheral portion 46 of the rear surface of the snap ring 44 may include exposed material of the snap ring 44 or may be covered by a thin layer of the material of the body 42 of the earcushion 40. In some implementations, this thin covering layer may have a thickness in the range of about 5-50 μm, for example about 10 μm.

At least a portion of the rear surface 52 of the body 42 of the earcushion 40 inside an inner periphery of the stepped portion 50 (see FIG. 6C) may be free of the material 48, thus exposing the pores on the rear surface 52 of the body 42 of the earcushion 40. The rear surface 52 of the body 42 of the earcushion 40 may thus be at least partially acoustically transparent and may allow acoustic energy to pass through the rear surface 52 of the body 42 of the earcushion 40 and into the bulk of the body 42 of the earcushion 40. The earcushion 40 may thus absorb acoustic energy generated or transmitted into a volume defined between the earcup 14 of a headphone 10 and the head or ear of a user, for example, sound rendered by an acoustic driver of the headphone 10 and reflected from the ear or head of the user, or any other reverberant acoustic energy present within the earcup plenum. Absorption of such acoustic energy may increase the quality of audio perceived by a user wearing a headphone 10 fitted with the earcushion 40.

Figure 6F:
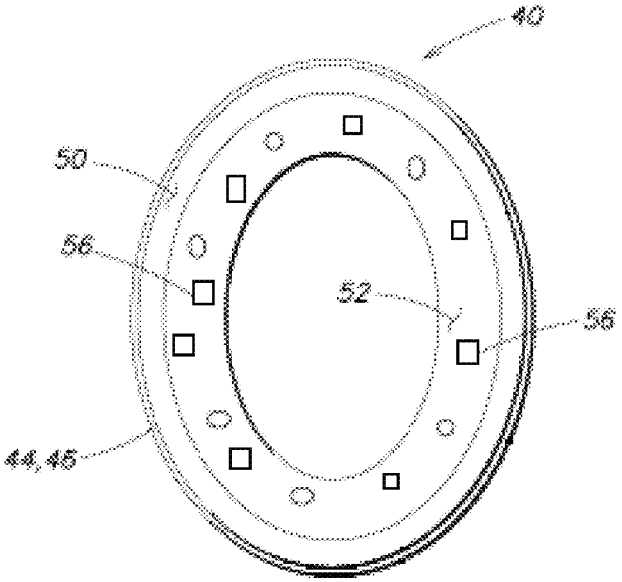
FIG. 6F is an example of the headphone cushion of FIG. 6A including cavities defined in a rear surface.

In some examples, as illustrated in FIG. 6F, the rear surface 52 of the body 42 of the earcushion 40 may include one or more cavities or depressions 56 extending from the rear surface 52 of the body 42 into the bulk of the body 42. The one or more cavities or depressions 56 may be circular, oval, square, rectangular, or randomly shaped. The one or more cavities or depressions 56 may serve to somewhat decouple the external side wall of the earcushion from the internal sidewall of the earcushion, thus reducing direct mechanical transfer of forces applied at the external sidewall to the internal sidewall as compared to a similar earcushion 40 lacking the one or more cavities or depressions 56. The one or more cavities or depressions 56 may thus increase the comfort of the earcushion 40 for the wearer by making the earcushion "feel" softer. Similar cavities or depressions 56 may be defined in the earcushion 20.

As illustrated in FIG. 6E, an acoustic damper 54 may be embedded within the body 42 of the earcushion 40 (in this example, at or near the cross-sectional center of the body 42 of the earcushion 40). The acoustic damper 54 may be embedded at a substantially central location in the body 42 of the earcushion 40 as illustrated, although in alternate examples an acoustic damper 54 may alternatively or additionally be located proximate upper, lower, inner, or outer surfaces of the body 42 of the earcushion 40 or proximate or in contact with the snap ring 44. The acoustic damper 54 may include or consist of a material having a density greater than a density of the partially reticulated polymeric foam forming the body 42 of the earcushion 40. The material of the acoustic damper 54 may include, for example, silicone, metals, ceramics or other materials having a density greater than a density of the partially reticulated polymeric foam forming the body 42 of the earcushion 40. The acoustic damper 54 may be a ring or a rope having a substantially oval or circular shape. Alternatively, the acoustic damper 54 may be embedded as a high-density powder (e.g., a metal powder) dispersed throughout the body 42 of the earcushion 40 at regular or random intervals. The acoustic damper 54 may increase the effective density of the body 42 of the earcushion 40 to substantially attenuate the acoustic signal from outside the earcushion 40 that passes through the earcushion 40 to the ear of the user as compared to a similar earcushion 40 without the acoustic damper 54.

Figure 6G:
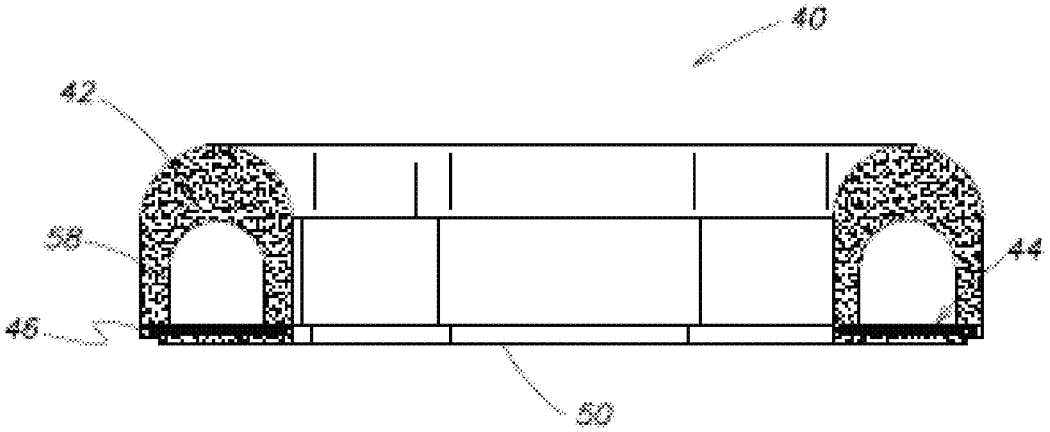
FIG. 6G is an example of the headphone cushion of FIG. 6A including a hollowed-out portion.
Figure 6H:
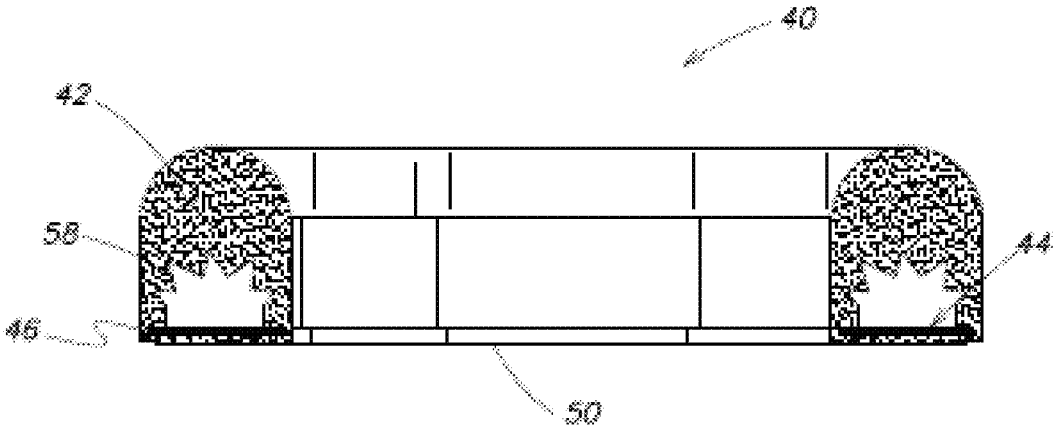
FIG. 6H is another example of the headphone cushion of FIG. 6A including a hollowed-out portion.

In further implementations, the body 42 of the earcushion 40 may include a hollowed-out portion or molded cavity 58, as illustrated in FIG. 6G. The hollowed-out portion or molded cavity 58 may render the body 42 of the earcushion 40 substantially U-shaped. The hollowed-out portion or molded cavity 58 may increase the pliability of the earcushion 40 as compared to a similar earcushion 40 without the hollowed-out portion or molded cavity 58, rendering the earcushion 40 more comfortable for a user to wear. Such a hollowed-out portion or molded cavity may also be present in alternate examples of the earcushion 20. The hollowed-out portion or molded cavity may be formed with different shapes, for example, a star-like shape or even a random shape, for example, as illustrated in FIG. 6H. These random shapes may be designed to further enhance the listening experience of the user.

Having thus described several aspects of at least one implementation, it is to be appreciated various alterations, modifications, and improvements will readily occur to those skilled in the art. Such alterations, modifications, and improvements are intended to be part of this disclosure and are intended to be within the spirit and scope of the disclosure. The acts of methods disclosed herein may be performed in alternate orders than illustrated, and one or more acts may be omitted, substituted, or added. One or more features of any one example disclosed herein may be combined with or substituted for one or more features of any other example disclosed. Accordingly, the foregoing description and drawings are by way of example only.

The phraseology and terminology used herein is for the purpose of description and should not be regarded as limiting. As used herein, the term "plurality" refers to two or more items or components. As used herein, dimensions which are described as being "substantially similar" should be considered to be within about 25% of one another. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A headphone cushion comprising:

a body formed of a partially reticulated polymeric foam, the body comprising a front surface configured to engage or surround an ear or head of a user, side surfaces, and a rear surface;

a layer of high-density polymer material extending over at least a portion of the body; and a snap ring at least partially embedded in the body, the snap ring comprising a periphery configured to engage one or more retention elements of an earcup of a headphone, and a curved portion having a concave surface that faces away from the ear of the user when the front surface of the headphone cushion is held adjacent the ear or head of the user, the curved portion forming an acoustic wall that improves passive transmission loss performance of the headphone cushion.

2. The headphone cushion of claim 1, wherein the acoustic wall improves passive transmission loss performance of the headphone cushion for acoustic frequencies in a range of about 0.2 kHz to about 6.5 kHz.

3. The headphone cushion of claim 1, wherein the body comprises a stepped portion extending from the rear surface of the body and onto one of an internal periphery and an external periphery of a rear surface of the snap ring.

4. The headphone cushion of claim 1, further comprising a non-porous film on the front and side surfaces of the body, the non-porous film being distinct from the layer of high-density polymer material.

5. The headphone cushion of claim 1, wherein the high-density polymer material comprises at least one of silicone and molybdenum.

6. The headphone cushion of claim 1, wherein the layer of high-density polymer material extends over at least a portion of the front surface.

7. The headphone cushion of claim 6, wherein the layer of high-density polymer material extends at least substantially entirely over the front surface and uniformly coats the front surface.

8. The headphone cushion of claim 1, wherein the rear portion of the body comprises at least one cavity defined between an inner periphery and an outer periphery of the rear portion of the body.

9. The headphone cushion of claim 1, wherein the layer of high-density polymer material has a thickness of between about 10 μm and about 100 μm.

10. A headset comprising:

an earcup having a front opening configured to be adjacent to an ear or head of a user when worn by the user; and a headphone cushion secured to the front opening of the earcup, the headphone cushion comprising:

a body formed of a partially reticulated polymeric foam, the body comprising a front surface configured to engage or surround the ear or head of the user, and a rear surface;

a layer of high-density polymer material extending over at least a portion of the body; and a snap ring at least partially embedded in the body, the snap ring comprising a periphery configured to engage one or more retention elements of the earcup of the headphone, and a curved portion having a concave surface that faces away from the ear of the user when the front surface of the headphone cushion is held adjacent the ear or head of the user, the curved portion forming an acoustic wall that improves passive transmission loss performance of the headphone cushion.

11. The headset of claim 10, wherein the one or more retention elements of the earcup comprise one or more detents extending inwardly from an inner wall of the earcup, and the snap ring is configured to engage rear surfaces of the one or more detents to secure the headphone cushion to the front opening of the earcup.

12. The headset of claim 10, wherein the one or more retention elements of the earcup include one or more slots configured to receive one or more respective tabs extending from a rear surface of the snap ring.

13. The headset of claim 10, wherein the headphone cushion further comprises a non-porous film integral with the front surface of the body, the non-porous film being distinct from the layer of high-density polymer material.

14. The headset of claim 10, wherein the body of the headphone cushion comprises a stepped portion extending from the rear surface of the body, onto an internal periphery of a rear surface of the snap ring, and into an interior portion of the earcup.

15. A method of forming a headphone cushion, the method comprising:

molding a body, the body being formed of a partially reticulated polymeric foam and comprising a front surface configured to engage or surround an ear or head of a user, side surfaces, and a rear surface; and applying a layer of high-density polymer material to at least a portion of the body, the body being molded around a snap ring that is at least partially embedded in the body, the snap ring comprising a periphery configured to engage one or more retention elements of an earcup of the headphone, and a curved portion having a concave surface that faces away from the ear of the user when the front surface of the headphone cushion is held adjacent the ear or head of the user, the curved portion forming an acoustic wall that improves passive transmission loss performance of the headphone cushion.

* * * * *